US007467430B2

(12) United States Patent
Hornbach

(10) Patent No.: US 7,467,430 B2
(45) Date of Patent: Dec. 23, 2008

(54) HOSPITAL BED FOR THE TREATMENT OF PULMONARY DISEASES AND NOSOCOMIAL PRESSURE ULCERS

(75) Inventor: David W. Hornbach, Brookville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 11/930,930

(22) Filed: Oct. 31, 2007

(65) Prior Publication Data

US 2008/0047067 A1 Feb. 28, 2008

Related U.S. Application Data

(62) Division of application No. 11/147,933, filed on Jun. 8, 2005, now Pat. No. 7,322,059.

(60) Provisional application No. 60/579,080, filed on Jun. 11, 2004.

(51) Int. Cl.
*A47C 27/10* (2006.01)
*A61G 7/008* (2006.01)

(52) U.S. Cl. ..... 5/607; 5/600; 5/706

(58) Field of Classification Search ..... 5/609, 5/607, 608, 613, 600, 729, 706, 727
See application file for complete search history.

(56) References Cited

U.S. PATENT DOCUMENTS

| | | | |
|---|---|---|---|
| 2,113,286 | A | 4/1938 | White |
| 3,344,445 | A | 10/1967 | Crawford |
| 3,434,165 | A | 3/1969 | Keane |
| 4,586,492 | A | 5/1986 | Manahan |
| 4,658,450 | A | 4/1987 | Thompson |
| 4,868,937 | A | 9/1989 | Connolly |
| 4,947,496 | A | 8/1990 | Connolly |
| 5,303,437 | A | 4/1994 | Hung |
| 5,502,853 | A | 4/1996 | Singleton et al. |
| 5,640,729 | A | 6/1997 | Marino |
| 6,065,165 | A | 5/2000 | Delk et al. |
| 6,112,349 | A | 9/2000 | Connolly |
| 6,282,736 | B1 | 9/2001 | Hand et al. |
| 6,499,160 | B2 | 12/2002 | Hand et al. |
| 6,526,610 | B1 | 3/2003 | Hand et al. |
| 6,566,833 | B2 | 5/2003 | Bartlett |
| 6,609,260 | B2 | 8/2003 | Hand et al. |
| 6,662,391 | B2 | 12/2003 | Wilson et al. |
| 6,671,905 | B2 | 1/2004 | Bartlett et al. |
| 6,691,347 | B2 | 2/2004 | Hand et al. |
| 6,701,553 | B1 | 3/2004 | Hand et al. |
| 6,715,169 | B2 | 4/2004 | Niederkrom |

(Continued)

FOREIGN PATENT DOCUMENTS

| | | | |
|---|---|---|---|
| DE | 3937214 | A1 | 5/1991 |

(Continued)

OTHER PUBLICATIONS

Chironis, Nicholas P., Mechanisms & Mechanical Devices Sourcebook p. 145.

*Primary Examiner*—Alexander Grosz
(74) *Attorney, Agent, or Firm*—Barnes & Thornburg LLP

(57) ABSTRACT

A patient support is disclosed, including a deck comprising openings that accommodate removable modules.

23 Claims, 8 Drawing Sheets

U.S. PATENT DOCUMENTS

| | | | | |
|---|---|---|---|---|
| 6,721,976 | B2 | 4/2004 | Schwaegerle | |
| 6,728,983 | B2 | 5/2004 | Bartlett et al. | |
| 6,732,390 | B2 | 5/2004 | Krywiczanin | |
| 6,817,363 | B2 | 11/2004 | Biondo et al. | |
| 6,854,144 | B1 * | 2/2005 | Mehring, Jr. | 5/727 |
| 6,862,759 | B2 | 3/2005 | Hand et al. | |
| 6,862,761 | B2 | 3/2005 | Hand et al. | |
| 6,886,199 | B1 | 5/2005 | Schwaegerle | |
| 7,073,222 | B1 | 7/2006 | Skripps | |
| 2004/0010849 | A1 | 1/2004 | Krywiczanin et al. | |
| 2004/0011779 | A1 | 1/2004 | Krywiczanin et al. | |
| 2004/0168253 | A1 | 9/2004 | Hand et al. | |
| 2004/0226091 | A1 | 11/2004 | Hand et al. | |
| 2006/0016007 | A1 | 1/2006 | Hornback | |

FOREIGN PATENT DOCUMENTS

| | | | |
|---|---|---|---|
| WO | WO-0162151 | A1 | 8/2001 |
| WO | WO-0205740 | A2 | 1/2002 |

* cited by examiner

HOSPITAL BED FOR THE TREATMENT OF PULMONARY DISEASES AND NOSOCOMIAL PRESSURE ULCERS

CROSS-REFERENCE TO RELATED APPLICATION

This application is a divisional of U.S. patent application Ser. No. 11/147,933, filed Jun. 8, 2005, now U.S. Pat. No. 7,322,059, which claims the benefit of U.S. Provisional Patent Application Ser. No. 60/579,080 to Hombach, titled Hospital Bed for the Treatment Of Pulmonary Diseases and Nosocomial Pressure Ulcers, filed Jun. 11, 2004, the disclosures of both of which are expressly incorporated by reference herein.

BACKGROUND AND SUMMARY OF THE INVENTION

The present invention relates to a hospital bed. More particularly, the present invention relates to a therapeutic hospital bed for providing rotational therapy to a patient supported on a patient support surface.

Therapeutic beds configured to rotate a patient about a longitudinal axis are well known in the art. In some instances, a patient support surface is supported by a frame which, in turn, is laterally rotated about the longitudinal axis. In other instances, the patient support surface is supported by a rotationally stationary frame wherein the patient support surface itself is configured to laterally rotate the patient about the longitudinal axis. The rotational movement of the patient is often utilized to provide a means for pulmonary toileting. The primary goal of this procedure is to move sepsis in the lungs of a patient to promote the gas exchange between the alveoli and the pulmonary capillary in the lung. Furthermore, rotational movement of the patient is often utilized to reduce the occurrence of nosocomial pressure ulcers on the patient's body by reducing or preventing continuous, localized pressure on the body. As such, therapeutic hospital beds providing rotational therapy have proven effective in reducing respiratory problems and pressure ulcers in patients supported thereon.

In an illustrative embodiment of the present invention, a patient support includes a base, and a deck having an upper surface, a lower surface, and a plurality of openings extending between the upper surface and the lower surface. A plurality of modules are removably supported within the openings of the deck.

Further illustratively, each of the modules includes an inflatable bladder configured to couple to the upper patient support surface when inflated and to uncouple from the upper patient support surface when deflated. Each of the modules includes a fluid connector supported by the first end and configured to couple to a fluid supply.

Illustratively, a first linkage assembly operably couples the first side of the carriage to the base, and a second linkage assembly operably couples the second side of the carriage to the base. The first linkage assembly illustratively includes a first link, a second link extending parallel to the first link, a first arm having a first end pivotally supported by the base, and a second end pivotally coupled to the first link and the second link. The second linkage assembly illustratively includes a third link, a fourth link extending parallel to the third link, a second arm having a first end pivotally supported by the base, and a second end pivotally coupled to the third link and the fourth link. A connecting member is illustratively supported by the carriage, wherein the first link, the second link, the third link, and the fourth link are pivotally coupled to the connecting member.

Illustratively, a lower patient support surface is supported by the base below the carriage. First and second side bolsters are operably coupled to the lower patient support surface. The first and second side bolsters are configured to move relative to the lower patient support surface between a raised position and a lowered position.

According to a further illustrative embodiment, a patient support includes a base, and a carriage rotatably supported above the base. The carriage includes a first side, a second side, and a deck extending between the first side and the second side. An upper patient support surface is coupled to the deck. A first linkage assembly operably couples the first side of the carriage to the base, and a second linkage assembly operably couples the second side of the carriage to the base.

The first linkage assembly illustratively includes a first link, a second link extending parallel to the first link, a first arm having a first end pivotally coupled to the base, and a second end pivotally coupled to the first link and the second link. The second linkage assembly illustratively includes a third link, a fourth link extending parallel to the third link, a second arm having a first end pivotally supported by the base, and a second end pivotally coupled to the third link and the fourth link. A connecting member is illustratively supported by the carriage, wherein the first link, the second link, the third link, and the fourth link are pivotally coupled to the connecting member.

Illustratively, a mover is operably coupled to at least one of the first linkage assembly and the second linkage assembly and is configured to rotate the carriage.

Further illustratively, a plurality of modules are removably supported by the carriage and define a portion of the upper patient support surface.

Further illustratively, a lower patient support surface is supported by the base below the carriage, and first and second side bolsters are operably coupled to the lower patient support surface.

According to a further illustrative embodiment, a patient support includes a base, and a carriage supported above the base. The carriage includes first and second sides, and is supported for rotation in a clockwise direction from a center position to a first limit position, and in a counter-clockwise direction from the center position to a second limit position. An upper patient support surface is supported by the carriage and is configured to support a patient. A lower patient support surface is supported below the carriage, the lower patient support surface including a first portion which is configured to be exposed for contacting the patient only when the carriage is in the first limit position and a second portion which is configured to be exposed for contacting the patient only when the carriage is in the second limit position.

Illustratively, a first side bolster is operably coupled to the lower patient support surface adjacent the first portion, and a second side bolster is operably coupled to the lower patient support surface adjacent the second portion.

Illustratively, the first side bolster and the second side bolster are configured to move relative to the lower patient support surface between a raised position and a lowered position.

Illustratively a plurality of modules are removably supported by the carriage and define a portion of the upper patient support surface.

Illustratively, a first linkage assembly operably couples the first side of the carriage to the base, and a second linkage assembly operably couples the second side of the carriage to the base.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
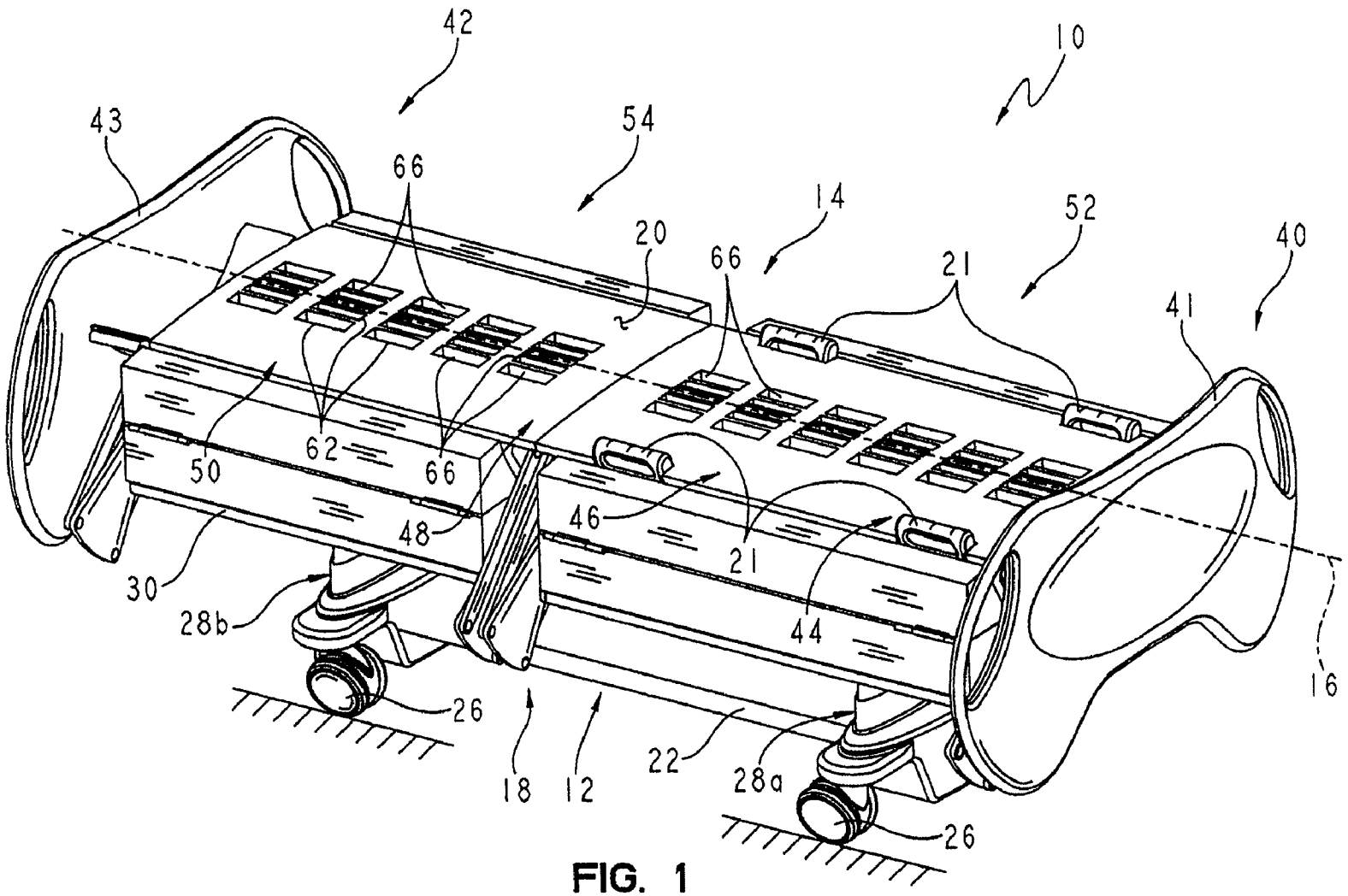
FIG. 1 is a perspective view of an illustrative embodiment therapeutic bed of the present invention.
Figure 2:
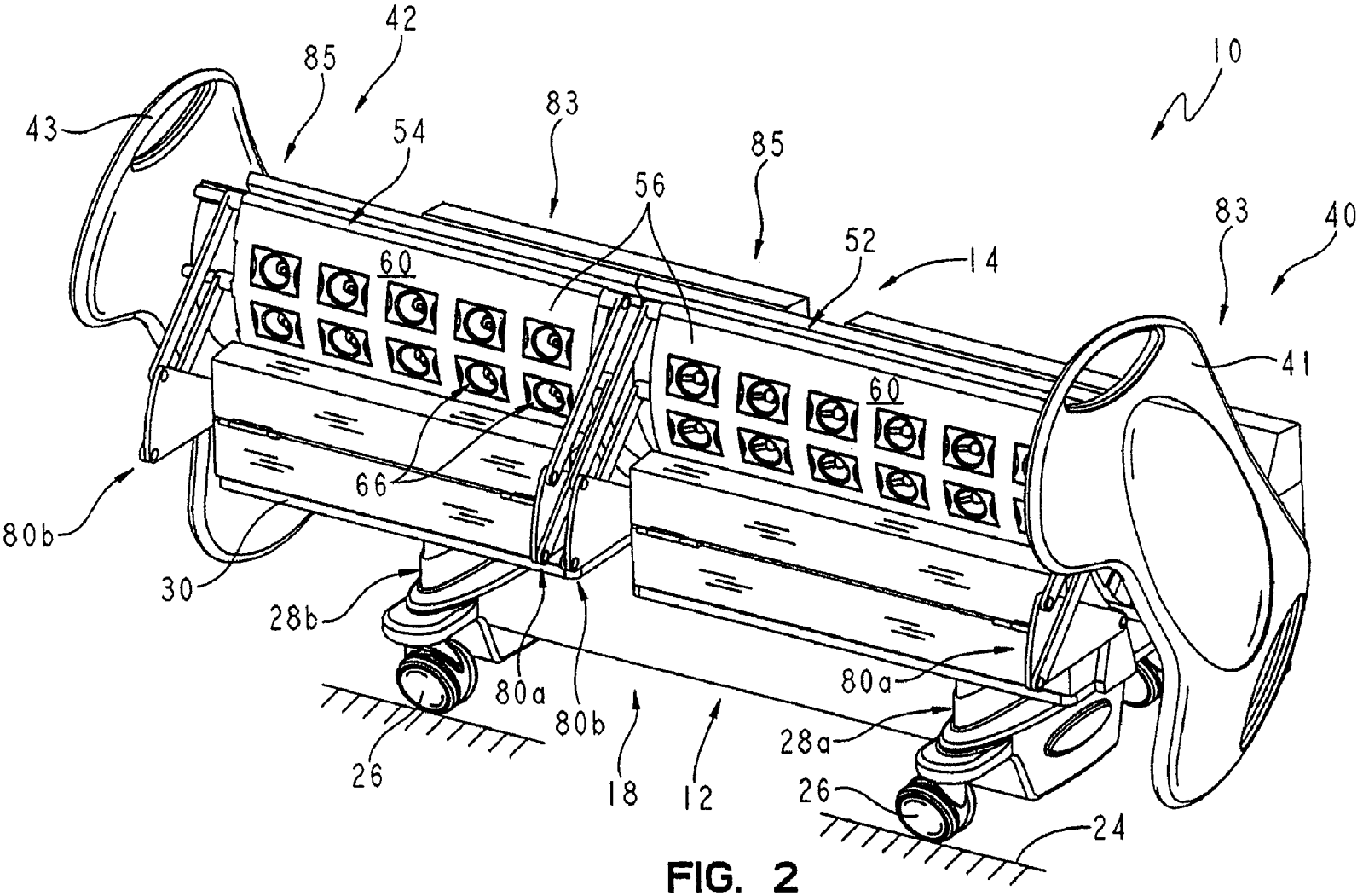
FIG. 2 is a perspective view similar to FIG. 1, illustrating a carriage of the bed rotated in a clockwise direction about a longitudinal axis.

Referring initially to FIGS. 1-4, a therapeutic hospital bed 10 according to an illustrative embodiment of the present invention includes a base 12 supporting a carriage assembly 14 for rotational movement about a longitudinal axis 16. A mover 18 operably couples the base 12 to the carriage assembly 14 and is configured to drive the carriage assembly 14 in rotational movement, including oscillating movement in opposite directions about the longitudinal axis 16. An upper patient support surface 20 is supported by the carriage assembly 14 and is configured to move therewith. The longitudinal axis 16 is configured to be positioned at the center plane, or higher, of the bronchus of the lungs of a patient. As such, rotation about the longitudinal axis 16 facilitates positive fluid dynamic properties in the lungs at a reduced patient tilt angle. A plurality of handles 21 extend above the upper patient support surface 20 and are configured to be grasped by a patient supported on the upper patient support surface 20 as the carriage assembly 14 is rotated.

Figure 3:
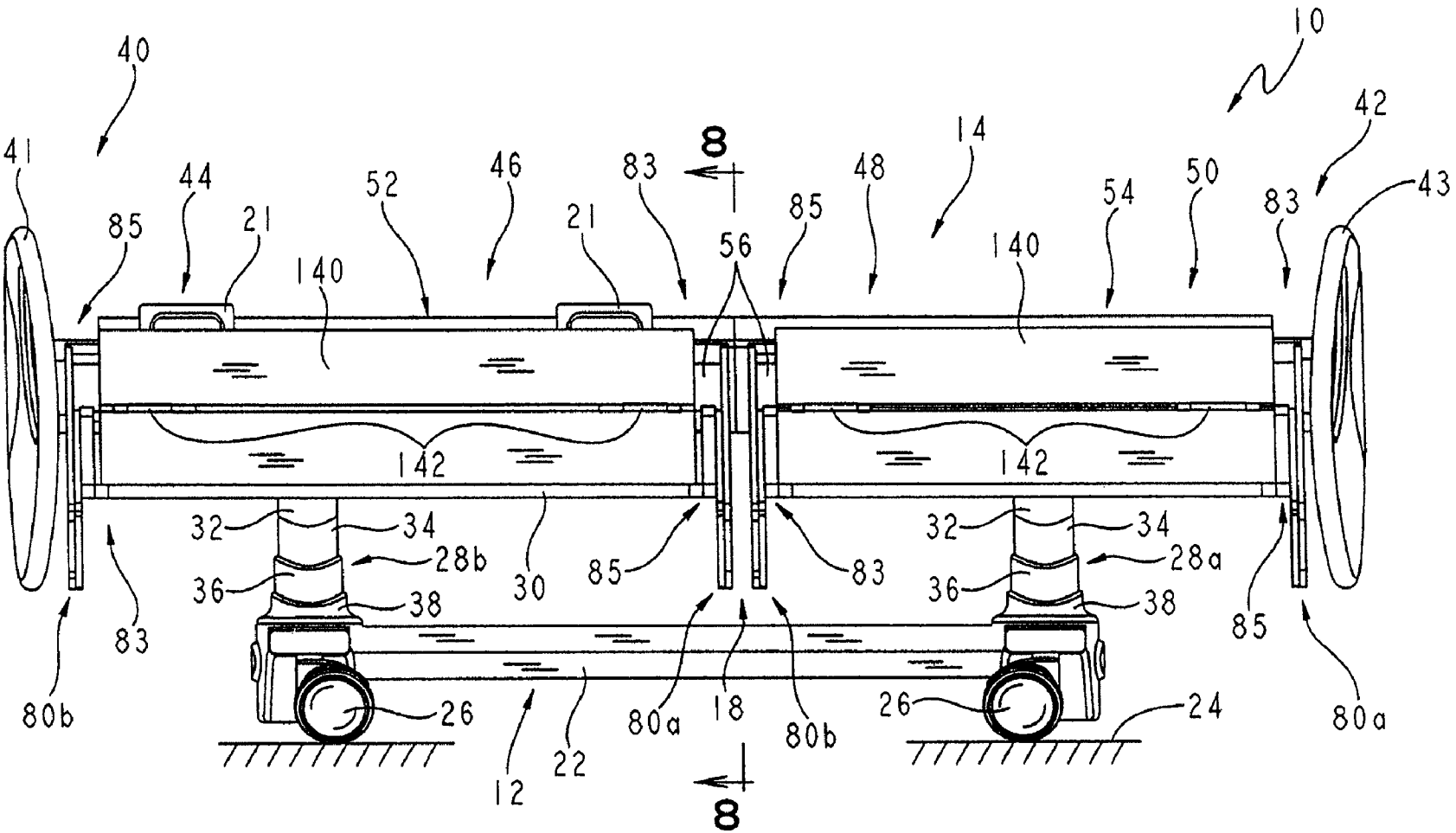
FIG. 3 is a side elevational view of the therapeutic bed of FIG. 1.

The base 12 illustratively includes a lower frame 22 supported for movement along on a floor 24 by a plurality of casters 26. Support columns 28*a* and 28*b* support an intermediate frame 30 above the lower frame 22. The support columns 28*a* and 28*b* may include telescoping portions 32, 34, 36, 38 of conventional design and which are configured to raise and lower the intermediate frame 30 relative to the lower frame 22 (FIG. 3). It should be appreciated that the support columns 28*a* and 28*b* may be operated independently such that the bed 10 may be placed in a Trendelenburg or reverse Trendelenburg position.

The therapeutic bed 10 includes a head end 40 and a foot end 42. A head section 44, a back section 46, a seat section 48, and a foot section 50 extend between the head end 40 and the foot end 42 (FIGS. 1 and 3). A headboard 41 is coupled to the carriage assembly 14 at the head end 40, and a footboard 43 is coupled to the carriage assembly 14 at the foot end 42.

In the illustrative embodiment, the carriage assembly 14 is supported above, and operably coupled to, the intermediate frame 30. The carriage assembly 14 illustratively includes a head end carriage 52 and a foot end carriage 54. However, it should be appreciated that the carriage assembly 14 may include any number of individual carriages, including a single unitary carriage or multiple independently movable carriages. The head end carriage 52 extends from the head end 40 through the head section 44 and the back section 46 of the bed 10. Similarly, the foot end carriage 54 extends from the foot end 42 through the foot section 50 and the seat section 48 of the bed 10. Both the head end carriage 52 and the foot end carriage 54 are substantially identical. As such, in the following detailed description similar components of the head end carriage 52 and the foot end carriage 54 will be identified with like reference numerals.

Figure 4:
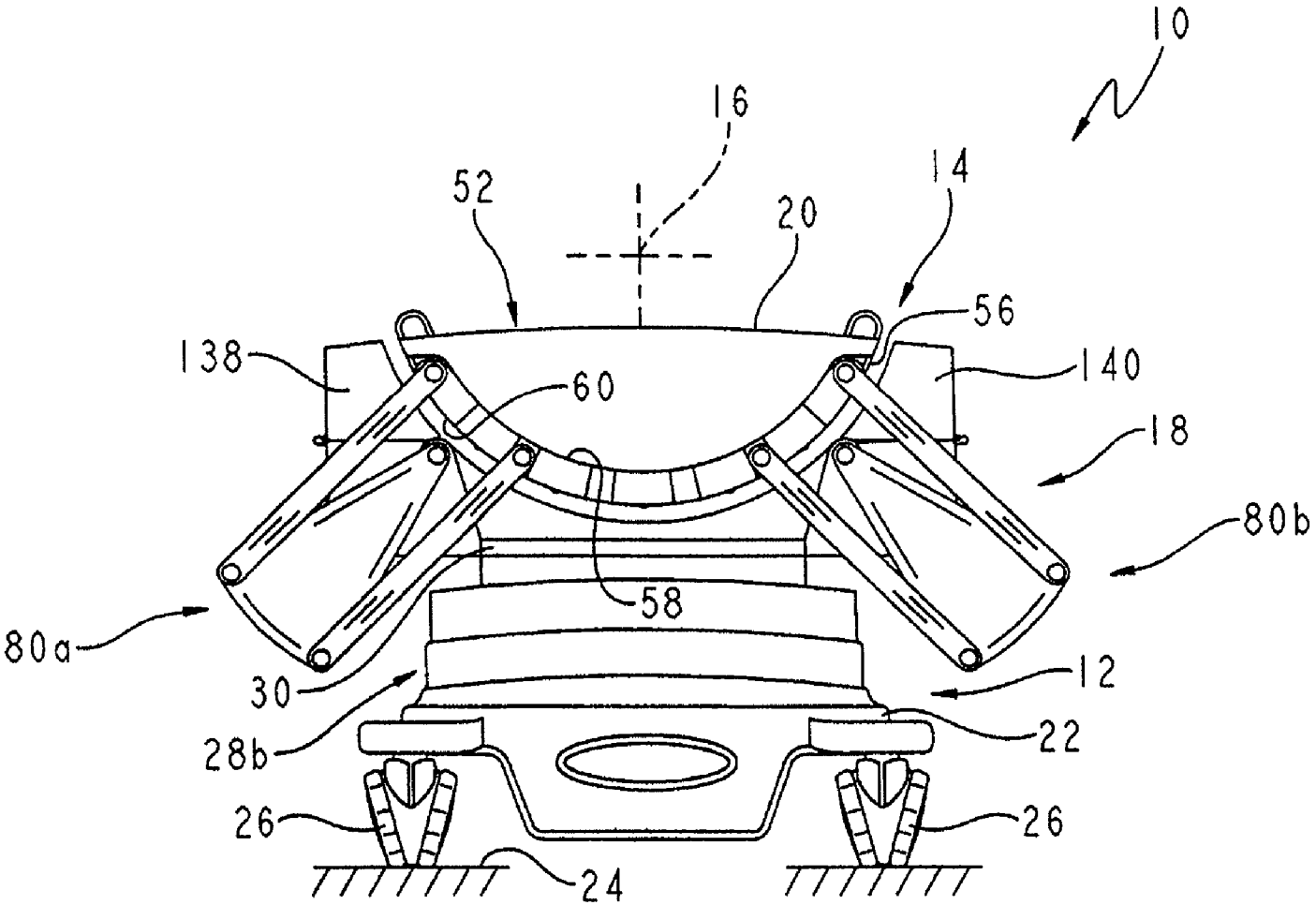
FIG. 4 is a head end view of the therapeutic bed of FIG. 1, with the headboard removed for clarity.
Figure 5:
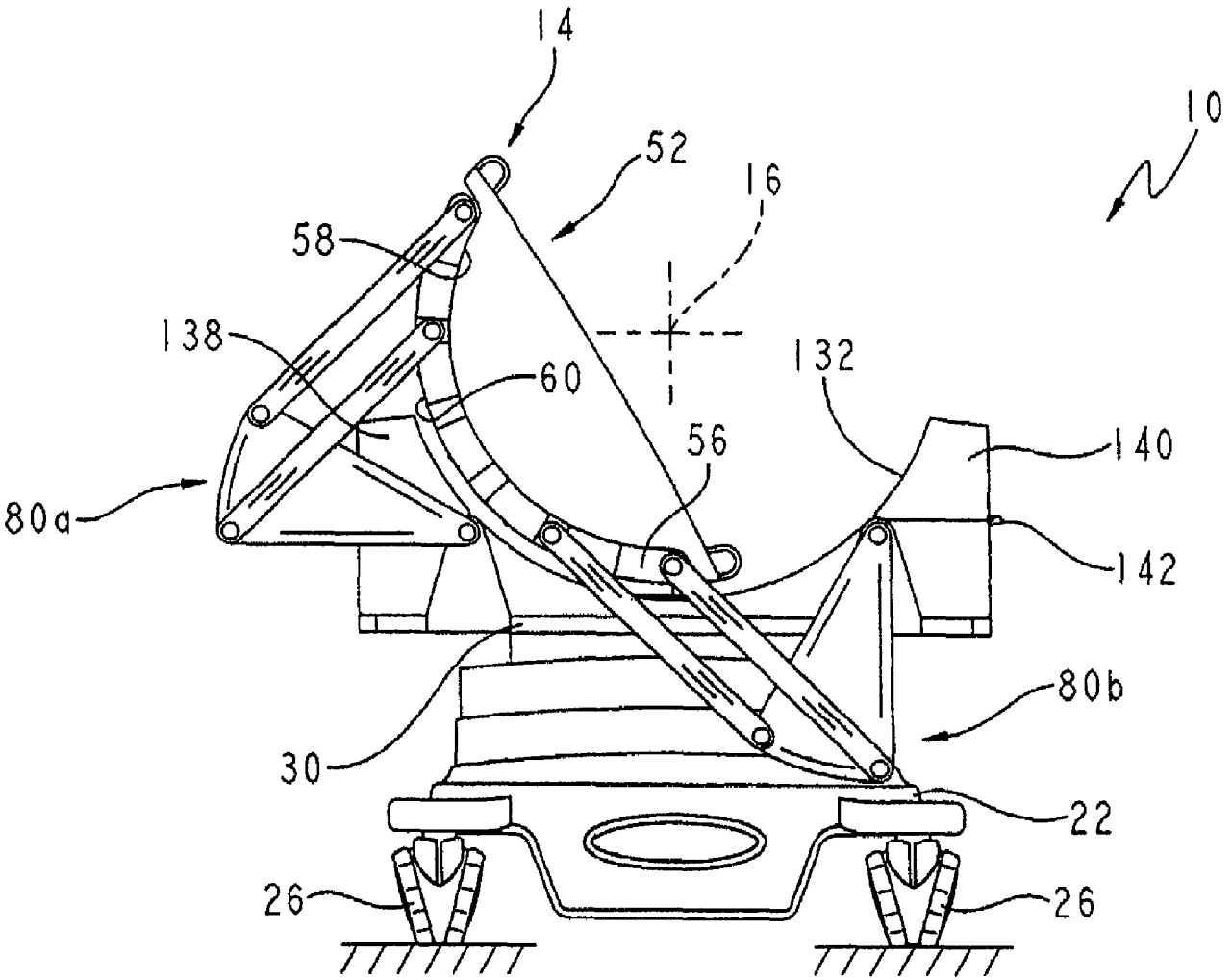
FIG. 5 is a head end view similar to FIG. 4, with the carriage rotated in a clockwise direction about the longitudinal axis.
Figure 6:
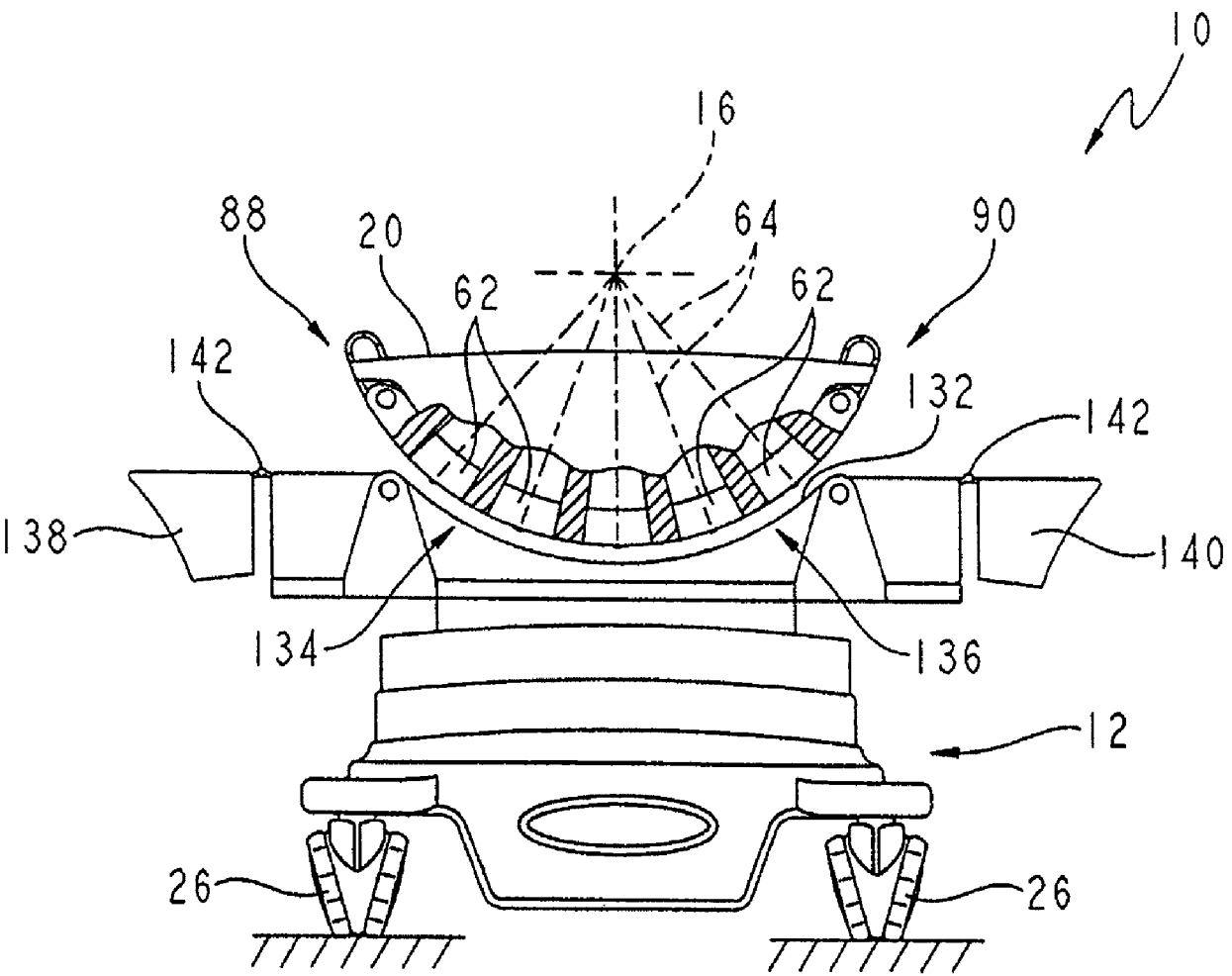
FIG. 6 is a head end view similar to FIG. 4, with a partial cut-away of the head end carriage to illustrate the openings within the deck.
Figure 7:
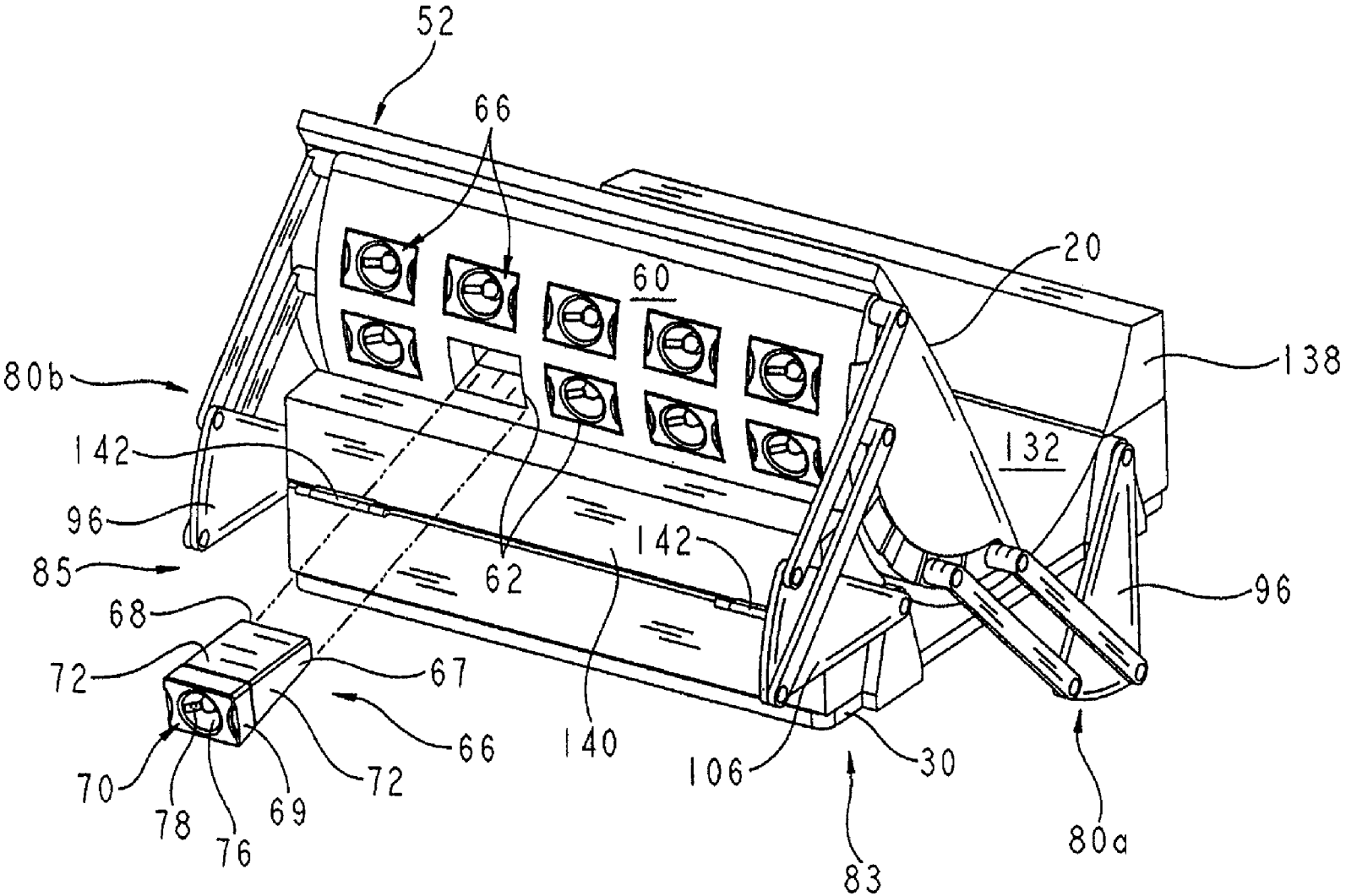
FIG. 7 is a perspective view of the head end carriage, rotated in a clockwise direction about the longitudinal axis and illustrating a module removed from an opening within the deck.

With further reference to FIGS. 2-7, each carriage 52 and 54 includes a deck 56 operably coupled to the upper patient support surface 20. The deck 56 extends parallel to the longitudinal axis 16 and has an upwardly facing arcuate lateral cross-section. The deck 56 includes an upper surface 58 and a lower surface 60 (FIG. 4). A plurality of openings 62 are formed within the deck 56 and extend from the lower surface 60 to the upper surface 58 (FIGS. 6 and 7). Each of the openings 62 includes a center axis 64, wherein the axes 64 of the plurality of openings 62 converge proximate the longitudinal axis 16 (FIG. 6).

As shown in FIG. 7, a plurality of removable modules 66 are supported within the openings 62. Each module 66 includes a bladder 67 defining an upper surface 68, and a base 69 defining a lower surface 70. The bladder 67 of each module 66 includes a plurality of sidewalls 72 which taper inwardly from the base 69 toward the upper surface 68. In other words, the sidewalls 72 generally define a wedge or truncated pyramid shape which is inserted within complementary shaped openings 62 in the deck 56. As detailed above, the sidewalls 72 and upper surface 68 define an inflatable bladder 67. The base 69 includes a recess 76 formed within the lower surface 70 and within which a fluid coupling 78 is received. The fluid coupling 78 is of conventional design and is configured to be coupled to a fluid supply and/or a vacuum (not shown). When the module 66 is in an inflated condition, for example by the supply of positive pressure, the bladder 67 is latched within the opening 62 of the deck 56. When the module 66 is in a deflated condition, for example by the application of a vacuum or negative pressure, then the bladder 67 may be slidably removed from and inserted into, as desired, the opening 62 of the deck 56.

As may be appreciated, when the carriage assembly 14 is rotated about longitudinal axis 16, the lower surface 60 of the deck 56 is accessible. The modules 66 may be removed from the lower surface 60 of the deck 56 by decreasing the pressure therein. Upon removal of the module 66, a caregiver can gain access to the patient supported on the upper patient support surface 20 for treatment and therapy. For example, upon removal of a module 66 a caregiver may apply treatment and therapy to pressure sores located in a specific area on the back of the patient. The module 66 may remain removed from its respective opening 62 for an extended period of time to dry or relieve pressure in a specific area.

In the illustrated embodiment of FIGS. 1-9, each carriage 52 and 54 includes twenty-five (25) modules 66 removably received within twenty-five (25) openings 62. However, it should be appreciated that the location and total number of modules 66 and corresponding openings 62 may be varied as required for different patient sizes, and for different treatment and therapy needs.

As shown in FIGS. 2, 3, and 7-9, the carriage assembly 14 is driven in rotation by the mover 18 which includes first and second linkage assemblies 80*a* and 80*b* operably coupled proximate opposing head and foot ends 83 and 85 of both the head end carriage 52 and the foot end carriage 54. Illustratively, first and second drives 82*a* and 82*b* are operably coupled to the first and second linkage assemblies 80*a* and 80*b*, respectively, positioned at foot end 85 of the head end carriage 52.

As illustrated, the linkage assemblies 80*a* and 80*b*, and the drives 82*a* and 82*b* are positioned entirely below the upper patient support surface 20 and, thus, are essentially hidden from the patient's view.

Figure 8:
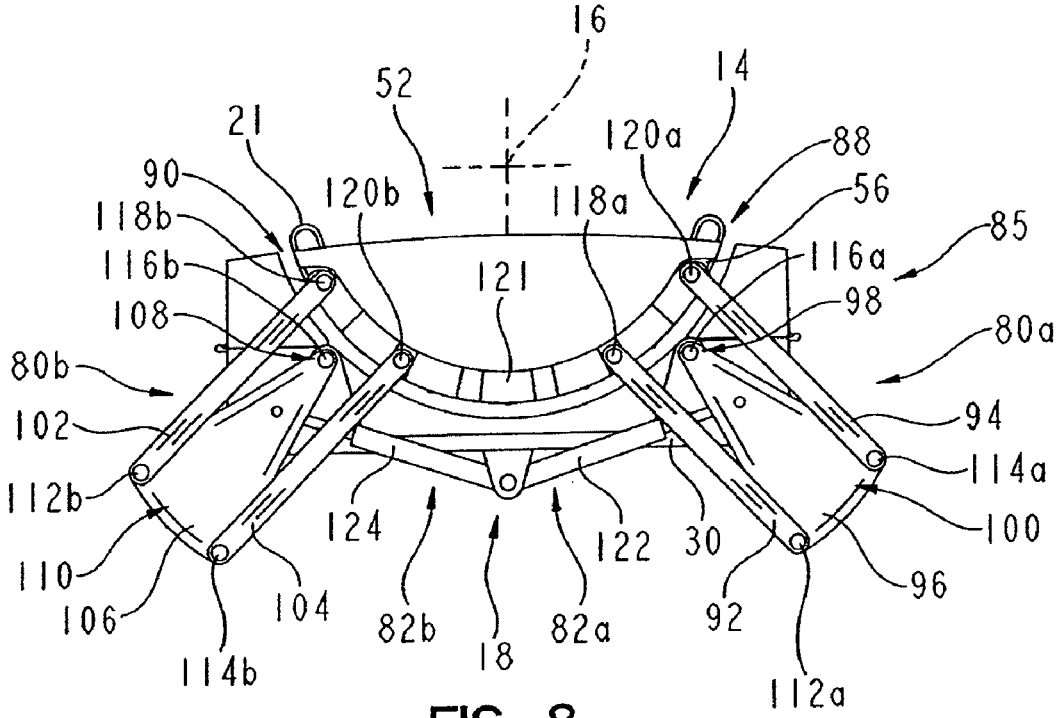
FIG. 8 is a diagrammatic foot end view of the head end carriage, taken along line 8-8 of FIG. 3 illustrating a mover operably coupled to the first and second linkage assemblies.
Figure 9:
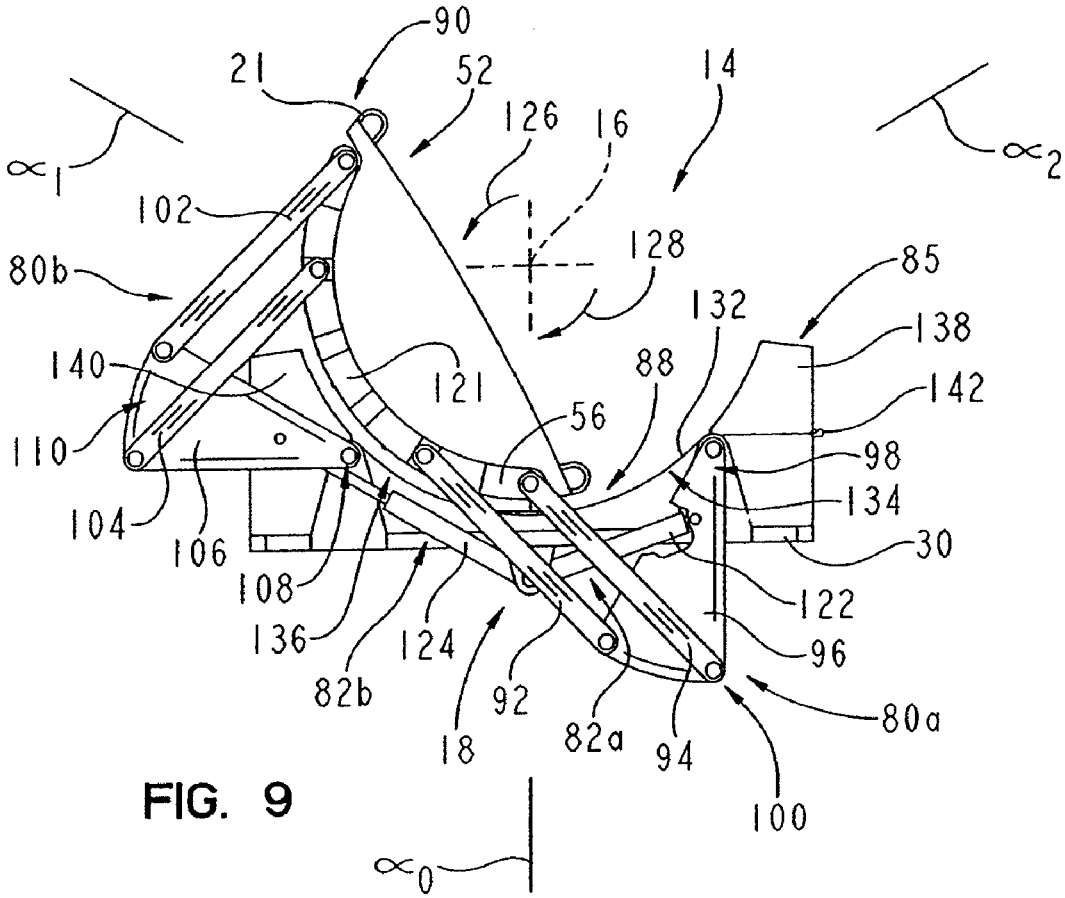
FIG. 9 is a diagrammatic foot end view similar to FIG. 8, with the carriage rotated in a clockwise direction about the longitudinal axis.

With reference to FIGS. 8 and 9, each linkage assembly 80*a* and 80*b* comprises a four bar linkage, illustratively a parallelogram linkage, guiding the respective carriage 52 and 54 in motion. The first linkage assembly 80*a* operably couples a first side 88 of the carriage assembly 14 to the intermediate frame 30, while the second linkage assembly 80*b* operably couples a second side 90 of the carriage assembly 14 to the intermediate frame 30. The first linkage assembly 80*a* includes a first link 92 and a second link 94 extending parallel to the first link 92. A first arm 96 has a first end 98 pivotally supported by the intermediate frame 30 at a pivot point 116*a*, and a second end 100 pivotally coupled to the first link 92 and the second link 94 at pivot points 112*a* and 114*a*. Similarly, the second linkage assembly 80*b* includes a third link 102 and a fourth link 104 extending parallel to the third link 102. A second arm 106 has a first end 108 pivotally supported by the intermediate frame 30 at a pivot point 116*b*, and a second end 110 pivotally coupled to the third link 102 and the fourth link 104 at pivot points 112*b* and 114*b*. An arcuate connecting member 121 is illustratively supported by the respective carriage 52 and 54. The first link 92 and the second link 94 are pivotally coupled to the connecting member 121 at pivot points 118*a* and 120*a*. Similarly, the third link 102 and the fourth link 104 are pivotally coupled to the connecting member 121 at pivot points 118*b* and 120*b*.

As noted above, the linkage assemblies 80*a* and 80*b* illustratively comprise parallelogram linkages. Pivot points 112 and 114 form a first triangle with, and rotate around, pivot point 116. This first triangle is congruent with a second triangle formed by pivot points 118 and 120 and the rotational axis 16.

Referring further to FIGS. 8 and 9, the first drive 82*a* and the second drive 82*b* illustratively comprise a first linear actuator 122 and a second linear actuator 124, respectively. The first linear actuator 122 is operably coupled to the first arm 96 and is configured to rotate the respective carriage 52 and 54 in a counter-clockwise direction, as illustrated by arrow 126 in FIG. 9. The second linear actuator 124 is operably coupled to the second arm 106 and is configured to drive the respective carriage 52 and 54 in a clockwise direction as indicated by arrow 128 in FIG. 9. The linear actuators 122 and 124 may comprise pneumatic cylinders of the type known in the art.

As noted above, the carriage assembly 14 is configured to be rotated in both clockwise and counterclockwise directions. The carriage assembly 14 is configured to rotate up to a first limit position, identified by $\alpha_1$ in FIG. 9, when rotated in a clockwise direction from a center position, identified as $\alpha_0$. Similarly, the carriage assembly 14 is configured to rotate in a counterclockwise direction up to a section limit position, identified by $\alpha_2$ in FIG. 9, as it is rotated in the counterclockwise direction from the center position $\alpha_0$. Illustratively, the angle from $\alpha_0$ to $\alpha_1$ and the angle from $\alpha_0$ to $\alpha_2$ may be approximately 110°. As such, the full angular rotation of the bed from the first limit position $\alpha_1$ to the second limit position $\alpha_2$ may be approximately 220°.

Referring now to FIGS. 5-7 and 9, a lower patient support surface 132 is supported vertically below the carriage assembly 14, and hence the upper patient support surface 20. The lower patient support surface 132 is supported by the intermediate frame 30 and includes a first portion 134 which is configured to be exposed for contacting the patient only when the carriage assembly 14 is in the first limit position $\alpha_1$, and a second portion 136, which is configured to be exposed for contacting the patient only when the carriage assembly 14 is in the second limit position $\alpha_2$. A first side bolster 138 extends above the lower patient support surface 132 adjacent the first portion 134, and a second side bolster 140 extends above the lower patient support surface 132 adjacent the second portion 136. Each of the first and second side bolsters 138 and 140 are pivotally coupled to the lower patient support surface 132, illustratively by hinges 142. As such, the side bolsters 138 and 140 may pivot downwardly from a raised position (FIG. 5) to a lowered position (FIG. 6). The lower patient support surface 132 is configured to assist in supporting the patient when the carriage assembly 14 is rotated from its center position $\alpha_0$. Similarly, the side bolsters 138 and 140 are configured to engage the patient when the carriage assembly 14 is in a rotated position. The side bolsters 138 and 140 may be pivoted downwardly to facilitate access to the removable modules 66, which assist in providing treatment and therapy to the back of a patient supported thereon, as detailed above.

Although the invention has been described in detail with reference to certain preferred embodiments, variations and modifications exist within the spirit and scope of the invention as described and defined in the following claims.

The invention claimed is:

1. A patient support comprising:

a base;

a deck having an upper surface, a lower surface, and a plurality of openings extending between the upper surface and the lower surface; and a plurality of modules removably supported within the openings of the deck, wherein each of the modules includes an inflatable bladder configured to couple to the deck when inflated and to uncouple from the deck when deflated.

2. The patient support of claim 1, wherein each of the modules includes a first end accessible from the lower surface of the deck.

3. The patient support of claim 2, further comprising an upper patient support surface supported by the deck.

4. The patient support of claim 3, wherein each of the modules includes a second end forming a portion of the upper patient support surface.

5. The patient support of claim 4, further comprising a carriage rotatably supported above the base including the deck.

6. The patient support of claim 5, further comprising a first linkage assembly operably coupling the first side of the carriage to the base, and a second linkage assembly operably coupling the second side of the carriage to the base.

7. The patient support of claim 6, wherein the first linkage assembly includes a first link, a second link extending parallel to the first link, a first arm having a first end pivotably supported by the base and a second end pivotably coupled to the first link and the second link, and the second linkage assembly includes a third link, a fourth link extending parallel to the third link, a second arm having a first end pivotably supported by the base and a second end pivotably coupled to the third link and the fourth link.

8. The patient support of claim 7, further comprising a connecting member supported by the carriage, wherein the first link, the second link, the third link, and the fourth link are pivotably coupled to the connecting member.

9. The patient support of claim 5, further comprising a lower patient support surface supported by the base below the carriage.

10. The patient support of claim 9, further comprising first and second side bolsters extending above the lower patient support surface.

11. The patient support of claim 10, wherein the first and second side bolsters are configured to pivot downwardly relative to the lower patient support surface.

12. The patient support of claim 2, wherein each of the modules includes a fluid connector supported by the first end and configured to couple to a fluid supply.

13. A patient support comprising a frame, a deck supported by the frame, the deck including an upper surface, a lower surface spaced from the upper surface, and an opening extending from the upper surface to the lower surface of the deck, and a module removably inserted in the opening, the module including a base and a support member coupled to the base, the support member being shaped to complement the shape of the opening in the deck, wherein the support member is configured to support a portion of a person positioned on the patient support, wherein the support member includes an inflatable bladder.

14. The patient support of claim 13, wherein the bladder includes a plurality of sidewalls defining a shape which is insertable in the complementary shaped opening of the deck.

15. The patient support of claim 13, wherein each of the modules is configured to couple to the deck when inflated and to uncouple from the deck when deflated.

16. A patient support comprising a frame, a carriage assembly supported by the frame, at least a portion of the carriage assembly being rotatable about an axis located above the frame between a first position and a second position spaced from the first position, the carriage assembly including a first portion and a second portion spaced from the first portion, wherein when the carriage assembly is in the first position, the first portion of the carriage assembly is removable to access a first region of a person positioned on the patient support, and when the carriage assembly is in the second position, the second portion of the carriage assembly is removable to access a second region of a person positioned on the patient support, wherein the first removable portion of the carriage assembly includes an inflatable bladder.

17. The patient support of claim 16, wherein the first removable portion of the carriage assembly is removable by decreasing pressure in the inflatable bladder.

18. The patient support of claim 16, further comprising a drive configured to rotate the carriage assembly about an axis which is positionable at least at the center plane of the lungs of a person positioned on the patient support.

19. A patient support comprising a base, a carriage assembly supported by the base, the carriage assembly including a head end carriage and a foot end carriage spaced from the head end carriage, each carriage including a deck having an upper surface and a lower surface spaced from the upper surface, and a plurality of openings extending from the upper surface to the lower surface of the deck wherein the deck has an upwardly facing arcuate lateral cross-section and each of the openings has a center axis, wherein the center axes of the openings converge at a point above the carriage assembly.

20. The patient support of claim 16, further comprising a base below the frame.

21. The patient support of claim 20, further comprising at least one support column coupled to the base.

22. The patient support of claim 21, wherein the frame is supported by the at least one support column to be raisable and lowerable relative to the base.

23. A patient support comprising:

a base;

a deck having an upper surface, a lower surface, and a plurality of openings extending between the upper surface and the lower surface; and a plurality of modules removably supported within the openings of the deck, wherein each of the modules includes a first end accessible from the lower surface of the deck, further comprising an upper patient support surface supported by the deck, wherein each of the modules includes a second end forming a portion of the upper patient support surface, further comprising a carriage rotatably supported above the base including the deck, further comprising a first linkage assembly operably coupling the first side of the carriage to the base, and a second linkage assembly operably coupling the second side of the carriage to the base, wherein the first linkage assembly includes a first link, a second link extending parallel to the first link, a first arm having a first end pivotably supported by the base and a second end pivotably coupled to the first link and the second link, and the second linkage assembly includes a third link, a fourth link extending parallel to the third link, a second arm having a first end pivotably supported by the base and a second end pivotably coupled to the third link and the fourth link.

* * * * *